US008348054B2

(12) United States Patent
Dragan

(10) Patent No.: US 8,348,054 B2
(45) Date of Patent: Jan. 8, 2013

(54) MULTI-PURPOSE, SMALL-GARMENT BAG STRUCTURE

(76) Inventor: Marinela Luminita Dragan, Portland, OR (US)

( * ) Notice: Subject to any disclaimer, the term of this patent is extended or adjusted under 35 U.S.C. 154(b) by 51 days.

(21) Appl. No.: 12/953,396

(22) Filed: Nov. 23, 2010

(65) Prior Publication Data

US 2012/0024727 A1 Feb. 2, 2012

Related U.S. Application Data

(60) Provisional application No. 61/369,681, filed on Jul. 31, 2010.

(51) Int. Cl.
*A45C 13/03* (2006.01)
*B65D 85/18* (2006.01)

(52) U.S. Cl. ..... 206/292; 206/287; 383/97; 383/119; 223/98; 24/DIG. 29

(58) Field of Classification Search ..... 24/DIG. 29; 206/387, 290, 292, 293; 383/97, 117, 42; 223/98
See application file for complete search history.

(56) References Cited

U.S. PATENT DOCUMENTS 1,065,450 A * 6/1913 Klein ..... 206/287
1,320,869 A * 11/1919 Kinsey ..... 206/287
1,477,566 A * 12/1923 Kaszinski ..... 383/68
2,082,011 A * 6/1937 Lee ..... 206/293
2,598,614 A * 5/1952 Gilbert ..... 211/113
3,264,755 A * 8/1966 Moore ..... 34/622
3,769,819 A 11/1973 Contreras
3,972,094 A 8/1976 Fuller
4,949,842 A * 8/1990 Mokiao, II ..... 206/286
5,067,618 A 11/1991 Johnson
5,137,149 A * 8/1992 Polacek ..... 206/278
5,253,775 A 10/1993 Gould
5,651,455 A * 7/1997 Garcia ..... 206/287.1
6,976,786 B1 * 12/2005 Stanley, Jr. ..... 383/25
7,481,340 B2 * 1/2009 Murphy ..... 223/85
7,631,753 B1 * 12/2009 Temmel ..... 206/290
7,712,641 B2 * 5/2010 Snyder ..... 223/88
2005/0232519 A1 10/2005 Grimes, Jr.

* cited by examiner

*Primary Examiner* — Sue Weaver
(74) *Attorney, Agent, or Firm* — Jon M. Dickinson, P.C.

(57) ABSTRACT

A combined, flexible and floppy laundry, travel, storage/display bag structure for socks and like small clothing articles, including (a) a machine-launderable/dryable, open-mesh, fabric bag having front and back sides, and spaced top, bottom and lateral edges, (b) located intermediate the bag's top and bottom edges, an elongate openable/closeable closure structure joined to and extending laterally across the bag's front side and between its lateral edges, and furnishing user-selective access to the inside of the bag, and (c) plural, releasable, clothing-article-holding structures mounted inside the bag on its back side, made manually accessible, via the closure structure, for operative gripping and releasing, within the bag, of user-selected clothing articles.

4 Claims, 3 Drawing Sheets

MULTI-PURPOSE, SMALL-GARMENT BAG STRUCTURE

CROSS REFERENCE TO RELATED APPLICATION

Figure 1:
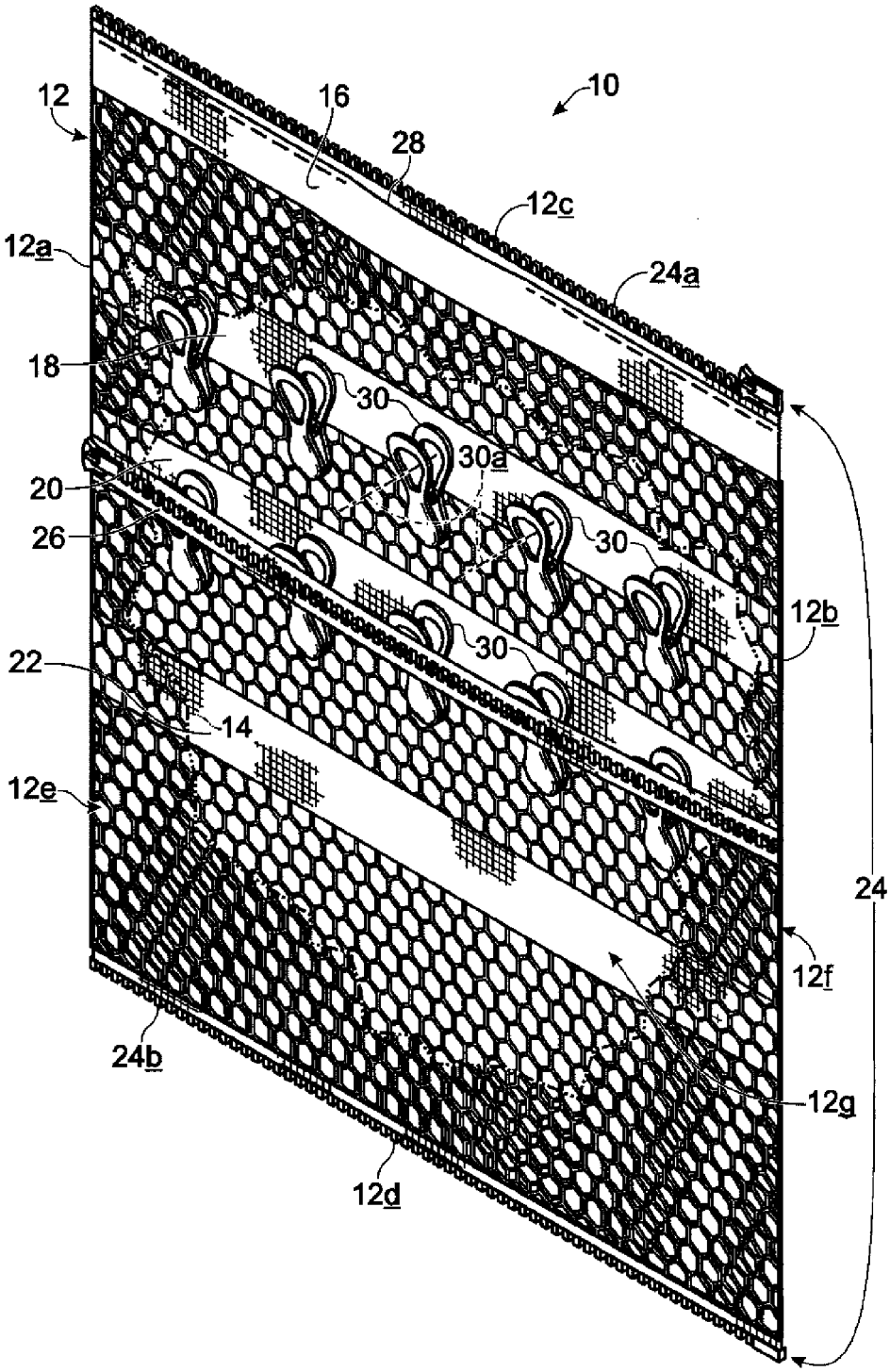

This application claims priority to currently co-pending U.S. Provisional Patent Application Ser. No. 61/369,681, filed Jul. 31, 2010, for "Multi-Purpose, Small-Garment Bag Structure". The entire content of this provisional application is hereby incorporated herein by reference.

BACKGROUND AND SUMMARY OF THE INVENTION

This invention pertains to a multi-purpose, small-garment bag structure, and more particularly, to such a structure which may be used in singular, or co-attached plural-bag, forms, to furnish useful, convenient organizational handling and management control for various small, personal garments such as socks and underwear. The utility of this structure presents itself especially well in laundering, post-laundering drying, at-home storing, and traveling situations, as will become apparent.

The proposed bag structure (or bag), for and in these various settings, offers a number of combinational functionalities including, as illustrations, (a) receiving small garments, such as socks and underwear, and containing them neatly organized for machine (or hand) laundering as well as for machine (or non-machine) drying, (b) holding dried, laundered garments within the bag for storage, (c) collecting dirtied garments in preparation for laundering, (d) hanging garments within the bag structure on an otherwise conventional clothing hanger for pre-use storage display (or for other reasons), etc., if desired (as in a closet), and (e) containing "bagged" garments for travel purposes. The bag structure of the invention includes appropriate, releasably interengageable interconnection structures, such as matable zipper structures, adjacent opposite top and bottom edges enabling roll-folding, and holding of the bag structure in a roll-folded condition for, as an example, garment-contained compactness in a travel situation.

To meet these purposes, and to offer these features, the basic bag structure of the invention includes a principal bag formed of, for example, an open-mesh nylon fabric, such as the material known as laundry mesh, having front and back sides, and including an openable/closable closure structure, such as a regular zipper structure, extending laterally generally centrally across the front side of the bag. This central, lateral zipper structure furnishes access to the bag's inside, wherein reinforcing-band-anchored (and thus basically positionally stabilized), clothing-article-holding clips, such as alligator-like clips, are furnished, pivotally mounted, in laterally extending rows (preferably, though not necessarily, two rows) for the purpose of gripping and selectively releasing small garments for containment in and retraction from the bag. The reinforcing band mentioned may be formed of the material known as belting tape. The laterally extending openable/closable closure structure provided for access to the inside of the bag is conveniently located positionally adjacent the locations of the preferred two rows of clips. The clips preferably are pivotally mounted on the mentioned reinforcing band material, with the pivot axes for these clips being substantially normal to the "plane" of the bag under circumstances wherein the bag's confronting front and back sides are in conditions essentially flattened adjacent each other.

The mentioned zipper structures that are disposed adjacent the top and bottom edges of the bag, made, for example from what is known as "matable", separating zipper structures, enable plural bag structures to be connected for various purposes and conditions, such in a "vertical stack" for collective hanging as a plural-bag-structure unit, or for other reasons.

The upper edge of the proposed bag is reinforced with the same belting-type material mentioned above. Additionally, provided laterally centrally in this upper edge is a small access opening allowing for the passage of the hanging hook of a conventional clothing hanger whose main body may be disposed within the top of the bag to hold it and its contents for hanging purposes.

These and other features of the invention will become more fully apparent as the detailed description of it which now follows is read in conjunction with the accompanying drawings.

DESCRIPTIONS OF THE DRAWINGS

FIG. 1 is a top, frontal isometric view of a single bag structure made in accordance with the present invention. A portion of the front of this structure has been broken away in order to illustrate details of internal construction.

Figure 2:
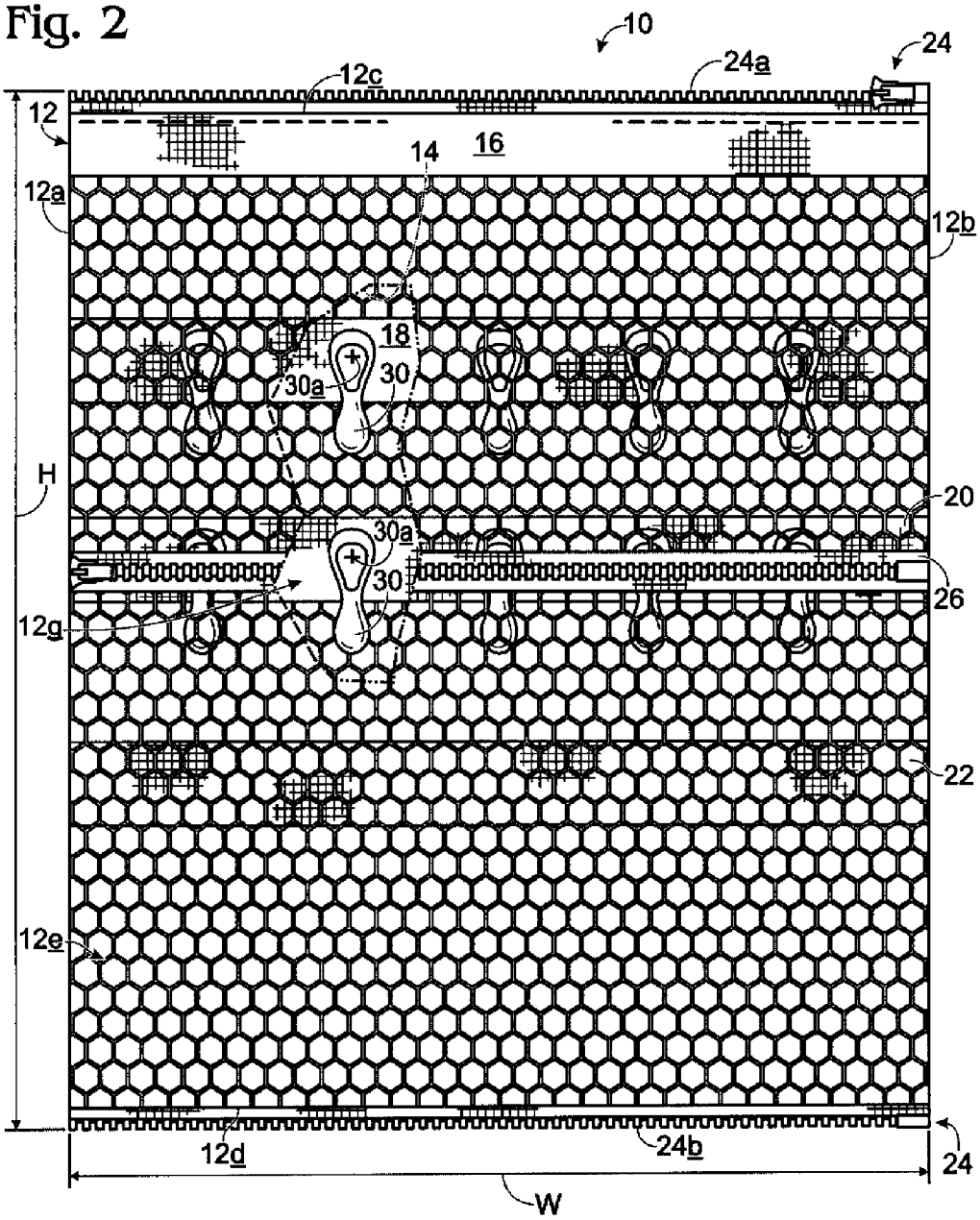

FIG. 2, which has been drawn on a slightly larger scale than that employed in FIG. 1, is a front elevation of the bag of FIG. 1, here, also, with a portion broken away to illustrate internal construction.

Figure 3:
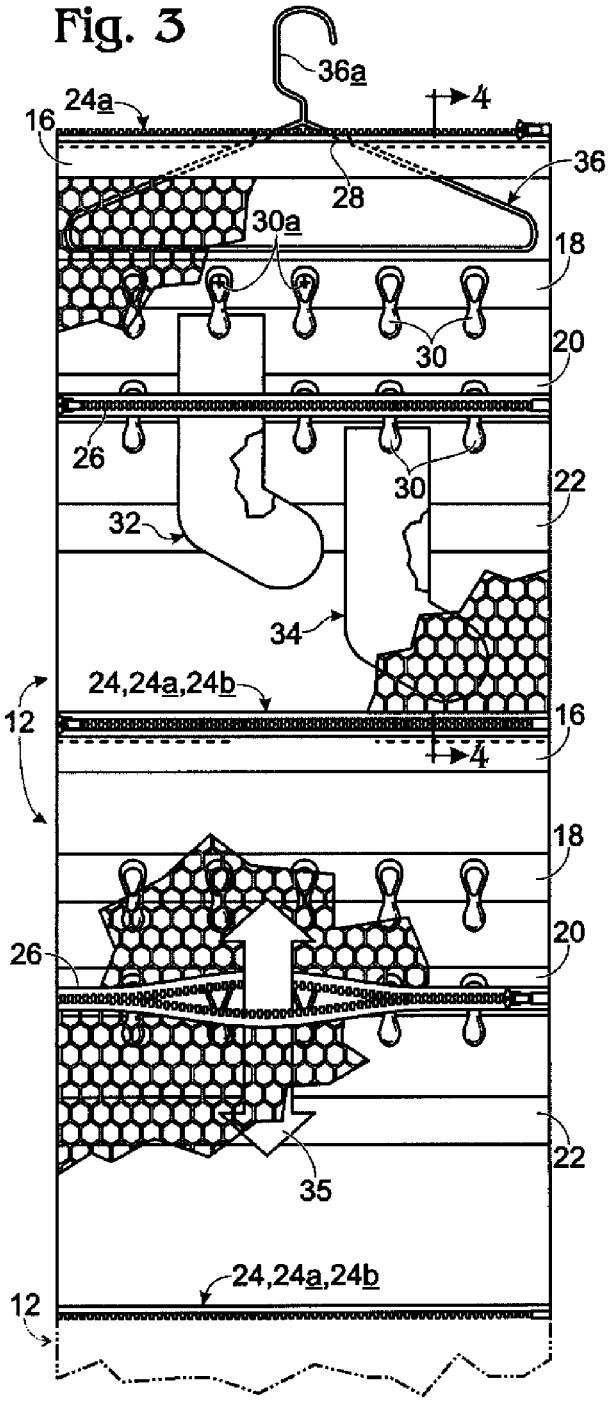

FIG. 3 presents a reduced-scale view of an assembly of three bag structures, each having the construction illustrated in FIGS. 1 and 2, zipped together, top-edge to bottom-edge, for storage-hanging purposes. The upper bag is shown associated with a conventional clothing hanger to enable hanging of the bag assembly for storage purposes, as in a closet. Selected portions of the bags illustrated in this figure have been shown only fragmentarily in order to illustrate details of construction.

Figure 4:
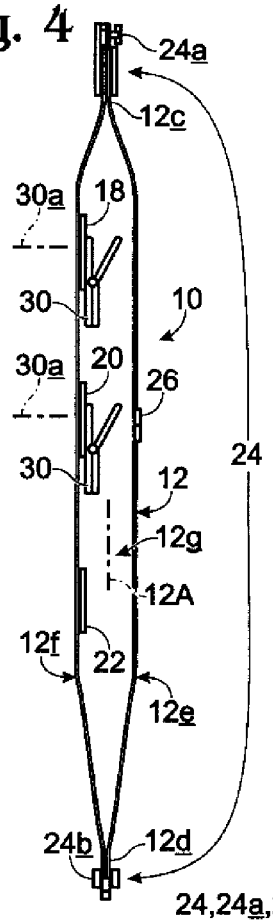

FIG. 4 is a simplified cross section taken generally along the line 4-4 in FIG. 3, and drawn on a scale which is slightly larger than that employed in FIG. 3.

Figure 5:
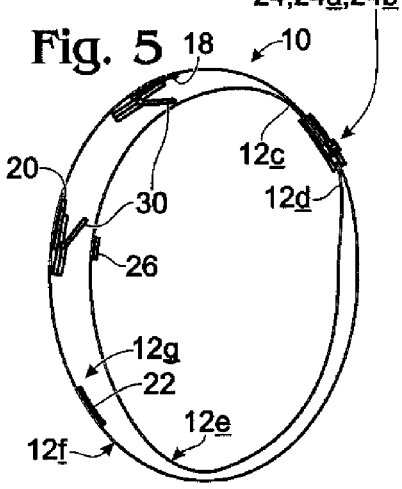

FIG. 5, which has been drawn on about the same scale as that employed in FIG. 4, illustrates the bag pictured in the FIG. 4 roll-folded upon itself, and retained in that condition by engaged, complementary components which form parts in an included matable zipper structure. These zipper structure components are provided adjacent the upper and lower edges of the bag.

DETAILED DESCRIPTION OF THE INVENTION

Turning attention now to the drawings, and referring first of all to FIGS. 1, 2 and 4, indicated generally at 10 is a combined laundry, travel, storage/display bag structure made in accordance with a preferred and best-mode embodiment of the present invention. Bag structure 10, which, generally speaking, is floppy and flexible in nature, includes, as its main body, an open-mesh, fabric bag 12 formed in any suitable fashion of a conventional machine-washable, machine-dryable, nylon laundry-mesh material. The bag illustrated herein is shaped generally in the form of an elongate rectangle, having a width W of about 18-inches between its lateral edges 12*a*, 12*b*, and a top-to-bottom height H of about 24-inches between its upper (or top) edge 12*c* and its bottom edge 12*d*. Bag 12 has front and back sides 12*e*, 12*f*, respectively, an inside 12*g* (seen especially well through a break-away opening in front side 12*e* in FIGS. 1 and 2 marked by a dash-double-dot line 14), and a nominal flattened condition, which is generally seen in the edge-view of it presented in FIG. 4, in which condition the bag can be thought of as occupying a plane, such as that shown for it by a dash-dot line 12A in FIG. 4.

The dimensions just stated are convenient and practical for most applications, but not in any sense critical.

At four locations in the bag structure pictured there are provided vertically spaced, laterally extending, narrow, reinforcing strips 16, 18, 20, 22 formed preferably of the conventional fabric material known as belting tape.

Attached across the bag's top edge 12*c*, immediately above reinforcing strip 16, is one complementary side 24*a* of a conventional matable zipper structure 24, the other complementary side, 24*b*, of which is attached across the bag's bottom edge 12*d*. The functions of zipper sides, or components, 24*a*, 24*b* will be explained shortly in relation to FIGS. 3 and 5. Components 24*a*, 24*b* are referred to collectively herein as selectively matable, releasably and complementarily interengageable, interconnection structures.

Openable and closeable access to the inside 12*g* of bag 12 is provided through a substantially full-width, laterally extending separation existing between upper and lower portions of the mesh fabric which forms front side 12*e*, and by operation of an appropriately there attached, conventional, regular zipper, or openable/closable closure structure, 26 which is disposed generally centrally between the top and bottom edges of the bag. This access feature, by way of which small garments are passed into and out of the bag during use, is located preferably, though not necessarily, about midway between the top and bottom edges of the bag.

Another, relatively small, somewhat slit-like opening into bag 12 is furnished laterally centrally at 28 adjacent the top edge of the bag, immediately above reinforcing strip 16 (as seen in FIG. 1). This opening is also referred to herein as a clothing-hanger hook-passage access opening, for a reason which will become immediately apparent from a look at FIG. 3. More will be said shortly about this structure.

Suitably pivotally attached to each of previously mentioned material strips 18, 20, at five locations on each strip, and spaced laterally along these strips, are five each, conventionally available, alligator-like clips, such as clips 30, which can pivot, or rotate, about axes, such as those shown 30*a*. Clips 30 are also referred to herein as plural, clothing-article holding structures.

Turning attention now to FIGS. 3 and 5 in conjunction with the other drawing figures, one will notice that, with respect to the specific locations illustrated for the alligator clips, these clips are conveniently positioned generally centrally (relative to the top and bottom of the bag) near the bag's front opening to furnish easy and direct access for the attachment and detachment of small garments, such as the two pairs of socks that are shown in FIG. 3, for example, clipped inside the upper one of the three zipper-attached bags pictured in this figure. An upper pair of socks 32 is shown clipped into place, and dangling by gravity, by one of the alligator clips attached to material strip 18, and another, similar pair of socks 34 is shown likewise clipped into place, and likewise dangling by gravity, by one of the alligator clips attached to material strip 20.

With regard to typical use of but a single bag made in accordance with the present invention, small garments, such as socks, like socks 32, 34, underwear, and other kinds of pieces (not specifically shown), in a ready-to-wash condition, are put into place and clipped within the bag which has been opened by manipulation of zipper 26 for that purpose (see broad, double-headed arrow 35 in FIG. 3). The bag is then re-closed, and the entire assemblage of bag and held garments is placed in a washing machine, or otherwise placed for hand laundering, in a condition where the held garments are retained in place, and neatly organized, during this process. Pairs of socks, for example, are kept together, and all garments in a bag may have been placed there for identification convenience on a person-specific basis.

When washing is completed, the bag and held-garments assemblage may then typically either be placed in a dryer, or alternatively, hung for air drying by using a conventional clothing hanger, such as the hanger which is illustrated at 36 in FIG. 3. When such a hanger is employed, its main body is disposed inside and near the top of the bag as shown, with the stem, or neck, of the hook in the hanger, such as that of the hook shown at 36*a*, extending upwardly through previously mentioned bag opening 28.

When the held garments are dry and ready for use, they may either be easily removed from the bag for conventional storage, or they may simply be stored and held in place inside the receiving bag, with the bag either hung for storage and display of the held garments as pictured in FIG. 3, or perhaps stored on a shelf or in a drawer in an otherwise conventional manner except that the held garments are bag-retained in a separated and easily identified manner.

Garments which are held in a bag and which are clean and ready (inside the bag) for storage, may readily be packed for travel in a very convenient manner.

At any point during the washing, drying and storing procedures just described, it is possible for a single bag, if desired, to be rolled and folded upon itself, as indicated in FIG. 5, and held in this condition simply by connecting the complementary components 24*a*, 24*b* in the associated matable zipper structure 24.

Another very convenient and sometimes useful manner of employing a bag of the present invention is illustrated effectively by what is shown in FIG. 3, where a plurality of bags becomes unified in a chain of bags through inter-bag connections of the matable zipper components. Such a chain of bags may also be rolled upon itself in the same manner illustrated for the single bag in FIG. 5.

The fact that attachment and support for bag-held garments is furnished through clips which are pivotally mounted, as explained, results in garments, particularly during storage and/or display after washing, neatly self-organizing because of the fact that they tend to dangle by gravity as pictured for the two pairs of socks shown in FIG. 3.

Accordingly, a unique, multi-function, combined laundry, travel, storage/display bag structure has been illustrated and described herein. Numerous features of the proposed bag structure have been discussed and are quite evident, but I recognize that other features and advantages are also available, and may be discovered by those generally skilled in the art. Accordingly, it is my intention that all claims to invention will be read to incorporate such additional features and advantages.

I claim:

1. A combined laundry, travel, storage/display bag structure, having a flexible and floppy nature, for socks and small articles of clothing, comprising a machine-launderable, machine-dryable, open-mesh, fabric bag having front and back sides, and spaced top, bottom and lateral edges, an elongate openable/closeable closure structure, joined to and extending laterally across the bag's front side and between its lateral edges, and located generally centrally intermediate the bag's top and bottom edges, furnishing user-selective access to the inside of the bag, and plural, releasable, clothing-article-holding structures mounted inside the bag on its back side, made manually accessible, via said closure structure, for operative gripping and releasing, within the bag, of user-selected small articles of clothing, said clothing-article-holding structures taking the form of laterally spaced alligator-like clips pivotally anchored, in at least one row, to a laterally extending, fabric-material mounting strip which is secured to the back side of the bag, for rotation about axes that are generally normal to a plane occupied by the bag when it is flattened.

2. The bag structure of claim 1 which further includes a clothing-hanger, hook-passage access opening disposed adjacent the bag's top edge, and opening between the inside and the outside of the bag.

3. The bag structure of claim 1 which further includes a pair of selectively matable, releasably and complementarily interengageable interconnection structures, one of which in said pair being of one category joined adjacent the top edge of the bag, and the other of which in said pair being of a second category joined adjacent the bottom edge of the bag.

4. The bag structure of claim 3 which further includes a clothing-hanger, hook-passage access opening disposed adjacent the bag's top edge, and opening between the inside and the outside of the bag.

* * * * *